US010894417B2

(12) United States Patent
Yamauchi

(10) Patent No.: US 10,894,417 B2
(45) Date of Patent: Jan. 19, 2021

(54) IMAGE FORMING APPARATUS

(71) Applicant: CANON KABUSHIKI KAISHA, Tokyo (JP)

(72) Inventor: Daigo Yamauchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/251,745

(22) Filed: Jan. 18, 2019

(65) Prior Publication Data

US 2019/0224980 A1 Jul. 25, 2019

(30) Foreign Application Priority Data

Jan. 24, 2018 (JP) ..... 2018-009611

(51) Int. Cl.
*B41J 2/175* (2006.01)
*B41J 29/13* (2006.01)
*B41J 29/02* (2006.01)

(52) U.S. Cl.
CPC ..... *B41J 2/17513* (2013.01); *B41J 29/02* (2013.01); *B41J 29/13* (2013.01)

(58) Field of Classification Search
CPC ..... B41J 2/17513; B41J 29/02; B41J 29/13
See application file for complete search history.

(56) References Cited

U.S. PATENT DOCUMENTS 8,857,959 B2 10/2014 Ishida et al.
2013/0051845 A1* 2/2013 Sato ..... G03G 15/6532 399/111
2013/0322945 A1* 12/2013 Nishimura ..... G03G 15/6558 399/395

FOREIGN PATENT DOCUMENTS

JP 2014-117858 A 6/2014

* cited by examiner

*Primary Examiner* — Jason S Uhlenhake
(74) *Attorney, Agent, or Firm* — Venable LLP

(57) ABSTRACT

An image forming apparatus includes: a frame having (i) a resin-molded bottom surface and (ii) a side surface (a) resin-molded integrally with the bottom surface and (b) extending upward from the bottom surface; an internal structure capable of supporting an image forming portion for forming an image on a recording material; and a screw for fixing the internal structure to the bottom surface of the frame, wherein the side surface is provided to surround the internal structure, at least one of the frame and the internal structure includes at least one restricting portion which restricts relative movement between the internal structure and the frame in a vertical direction to the bottom surface, and the at least one restricting portion is provided in a position at a smaller distance from an end of the side surface than from the bottom surface in the vertical direction.

10 Claims, 13 Drawing Sheets

IMAGE FORMING APPARATUS

BACKGROUND OF THE INVENTION

Field of the Invention

The present invention relates to an image forming apparatus.

Description of the Related Art

An image forming apparatus such as a printer or a copier has a frame for storing an internal structure which includes an image forming unit. FIG. 9 illustrates an exemplary frame structure for a conventional image forming apparatus. In FIG. 9, the frame for the image forming apparatus 100 includes a lower frame A having a bottom surface and side surfaces 104 and 105 and an upper frame B having an upper surface 102 and side surfaces 101 and 103, and the lower and upper frames are assembled in the vertical direction.

SUMMARY OF THE INVENTION

As in the conventional structure, when the two frames A and B are assembled in the vertical direction by screw fastening to form the frame for the image forming apparatus 100 as a whole, the following configuration is used for securing the total rigidity for the image forming apparatus 100. More specifically, edge portions 107 and 108, which extend from the side surfaces inwardly in parallel with the bottom surface (or the upper surface 102), are provided in the vicinity of the opening portions of the frames A and B, and the edge portions 107 and 108 are provided with screw holes 110, so that the screws 106 are fastened for fixing. The edge portions 107 and 108 are shaded in FIG. 9. In order to secure sufficient rigidity against external force acting to deform the image forming apparatus 100 as a whole, the edge portions 107 and 108 need sufficient widths, and securing a space for providing the edge portions 107 and 108 leads to an increase in the size of the image forming apparatus 100.

The present invention provides a solution to the problem, and it is an object of the present invention to provide a technique for allowing an image forming apparatus to have sufficient rigidity while restraining the size of the image forming apparatus from increasing.

An image forming apparatus according to the present invention includes:

a frame having (i) a resin-molded bottom surface and (ii) a side surface (a) resin-molded integrally with the bottom surface and (b) extending upward from the bottom surface;

an internal structure capable of supporting an image forming portion for forming an image on a recording material; and a screw for fixing the internal structure to the bottom surface of the frame, wherein the side surface is provided to surround the internal structure, at least one of the frame and the internal structure includes at least one restricting portion which restricts relative movement between the internal structure and the frame in a vertical direction to the bottom surface, and the at least one restricting portion is provided in a position at a smaller distance from an end of the side surface than from the bottom surface in the vertical direction.

According to the present invention, sufficient rigidity for the image forming apparatus may be secured while restraining the size of the image forming apparatus from increasing.

Further features of the present invention will become apparent from the following description of exemplary embodiments with reference to the attached drawings.

DESCRIPTION OF THE EMBODIMENTS

First Embodiment

A first embodiment of the present invention will be described. Note that according to the first embodiment, an image forming apparatus according to the present invention is applied to an electro-photographic image forming apparatus, and a monochrome electro-photographic printer which can be provided with a single detachable process cartridge will be described by way of illustration. However, the invention is applicable to an image forming apparatus having an internal structure and a four-sided frame which includes bottom, front, back, left and right surfaces for storing the internal structure and is not limited by the exemplary application according to the first embodiment. For example, the number of detachable process cartridges may be more than one (such as four) for an image forming apparatus which forms full-color images. The present invention may be applied to a copier, a facsimile, and an image forming apparatus such as a multifunction device which incorporates the functions of all the above devices.

Description of General Structure of Overall Image Forming Apparatus

Figure 1:
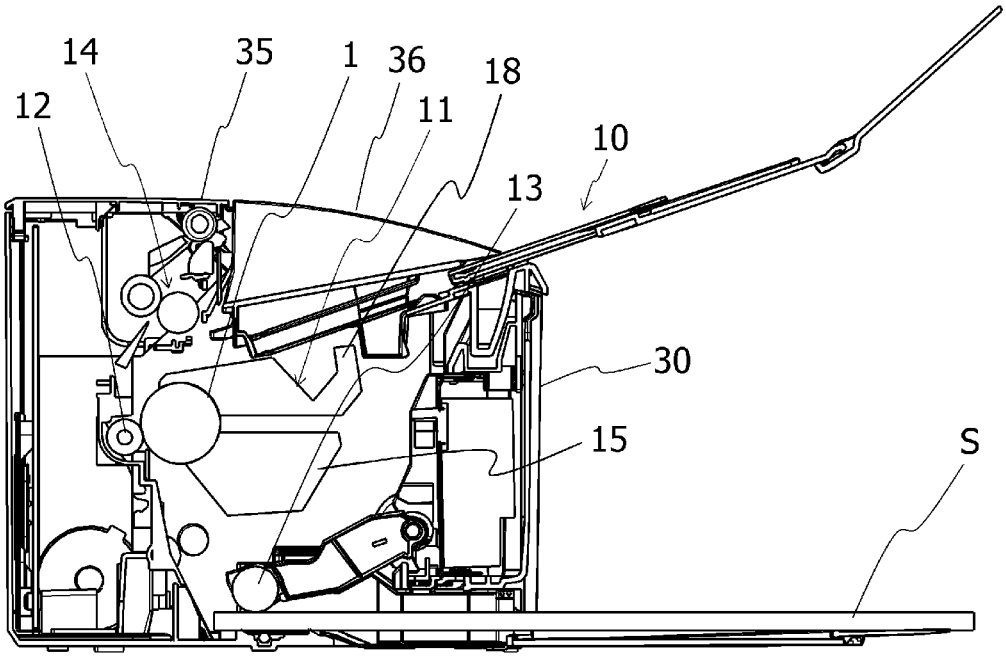
FIG. 1 is a schematic sectional view of an image forming apparatus according to a first embodiment of the present invention.

FIG. 1 is a schematic sectional view taken along a direction vertical to the left-right direction of an image forming apparatus according to the first embodiment. Note that the left-right direction herein refers to the left-right direction as viewed from the front of the image forming apparatus and a direction parallel to the installation surface for the image forming apparatus and vertical to the sheet surface of FIG. 1. The front-back direction refers to a direction connecting the front and back for the image forming apparatus and a direction parallel to the installation surface of the image forming apparatus and parallel to the left-right direction of the sheet surface of FIG. 1. In FIG. 1, the rightward in the sheet surface corresponds to the forward direction and the leftward corresponds to the rearward direction.

The image forming apparatus 10 forms an image on a recording medium using electrophotographic image forming process. The image forming apparatus 10 includes a detachable process cartridge 11 as the image forming unit. The detachable process cartridge 11 includes an electrophotographic photo-sensitive member (hereinafter as the "photosensitive drum") and a developing unit 15 which develops a latent image formed on the photosensitive drum 1. The image forming apparatus 10 has an optical unit 18 which forms an electrostatic latent image by subjecting the photosensitive drum 1 as a photosensitive member to laser exposure on the basis of image data. The image forming apparatus 10 forms a monochrome image on a recording material S (such as a paper sheet, a plastic sheet, and a piece of fabric) as a recording medium on the basis of the image data. The process cartridge 11 stores black toner. The recording material S is inserted into the image forming apparatus 10 from the opening at the front of the image forming apparatus 10 and sent to a nip part between a transfer roller 12 and the photosensitive drum 1 as the photosensitive member by paper feeding means 13. An electrostatic latent image is formed on the photosensitive drum 1 by the optical unit 18 on the basis of the image data, and the electrostatic latent image is developed as a toner image by the developing unit 15. In the process in which the recording material S is passed through the nip part between the photosensitive drum 1 and the transfer roller 12, the transfer roller 12 presses the recording material S toward the photosensitive drum 1. The transfer roller 12 is provided, by a biasing power supply, with biasing voltage of a polarity reversed from the polarity to which the toner is charged, and a toner image formed on the surface of the photosensitive drum 1 is transferred onto the surface of the recording material S. A fixing unit 14 is provided downstream of the nip part between the transfer roller 12 and the photosensitive drum 1, and the recording material S carrying the toner image is passed through the fixing unit 14 where the toner is heated and pressurized to melt and fixed on the recording material S. Through these operation steps, a monochrome print image is formed on the surface of the recording material S using the photosensitive member.

Exterior of Image Forming Apparatus

Now, the exterior of the image forming apparatus 10 will be described with reference to FIGS. 2A and 2B.

Figure 2A:
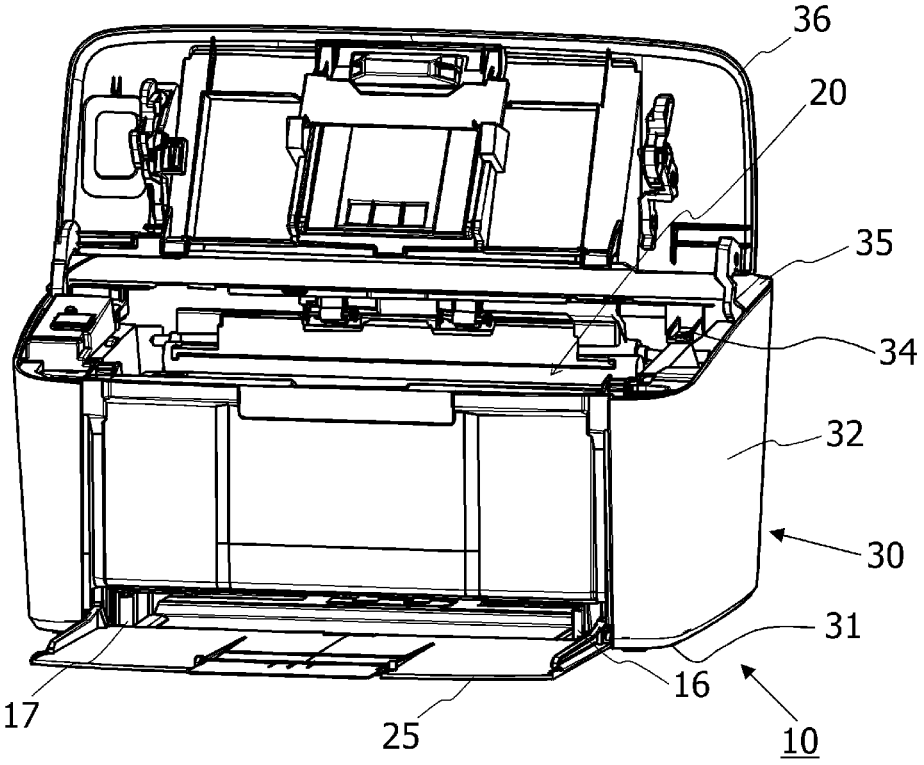
FIGS. 2A and 2B are perspective views of the image forming apparatus according to the first embodiment.

FIG. 2A is a perspective view of the image forming apparatus 10 as viewed from the front and above. The image forming apparatus 10 has an internal structure 20 capable of supporting the image forming unit for forming an image on the recording material S and a frame 30 for storing the internal structure. The frame 30 has a resin-molded bottom surface 31 and a side surface 32 resin-molded integrally with the bottom surface 31 and extending upward from the bottom surface 31 and is open on the upper side. The frame 30 is formed by so-called resin integral molding. Therefore, the resin-molded bottom surface 31 and the side surface 32 resin-molded integrally with the bottom surface 31 are formed to be continuous. The side surface 32 is provided to surround the internal structure 20. The image forming apparatus 10 has an upper cover 35 provided to cover the opening of the frame 30 on the upper side and the upper surface of the internal structure 20 and a pivotably openable cover 36 having a rotational center at the upper cover 35.

A paper feed port 17 is provided at the front part of the side surface 32 of the frame 30, and a paper feed tray 25 having a rotational center in the vicinity of the paper feed port 17 is attached thereto. The paper feed tray 25 has a guide member 16 which guides the recording material S.

Figure 2B:
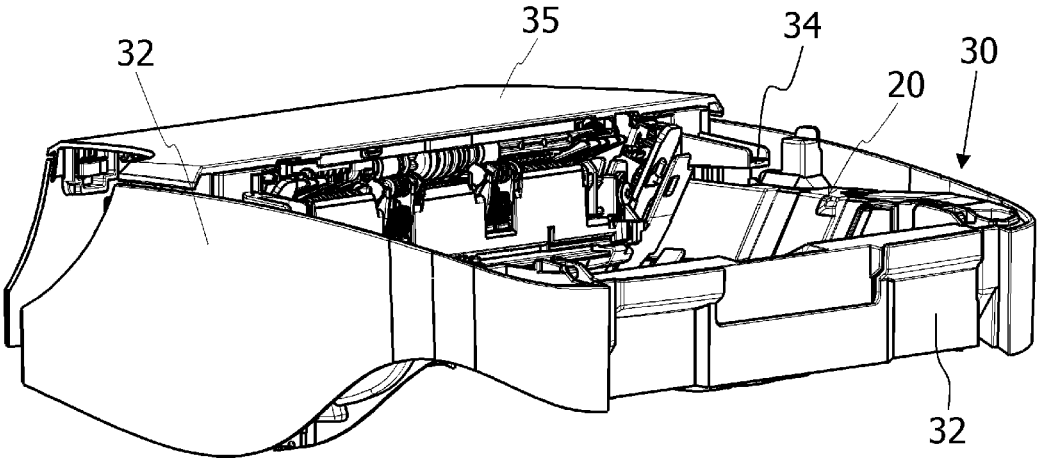

FIG. 2B is a perspective view of the image forming apparatus 10 indicating a schematic partial section viewed from the front and above. The upper cover 35 engages with a rear end of the side surface 32 of the frame 30 and is fastened and fixed to the upper part of the internal structure 20 by a screw 34.

The openable cover 36 is attached to have a rotational center at the upper cover 35 and rotatable between a closed position and an open position with respect to the image forming apparatus 10. As the openable cover 36 is in the closed position, the image forming apparatus 10 is allowed to form an image, and as the openable cover 36 is in the open position, the process cartridge 11 can be inserted/pulled out to/from the image forming apparatus 10. Note that according to the embodiment, the openable cover 36 is attached to have the rotational center at the upper cover 35, while the openable cover 36 may be attached to have a rotational center at the internal structure 20 or the frame 30.

In this way, the upper cover 35 and the openable cover 36 are members for mainly covering the upper part of the internal structure 20 and are not expected to function as members for securing the rigidity of the apparatus as a whole when combined with the lower frame as in the case of the illustrated conventional apparatus. Therefore, the upper cover 35 and the openable cover 36 may be formed to have a simple and flat structure, which is advantageous over the illustrated conventional apparatus in that the size and cost of the apparatus can be restrained from increasing.

Engagement Between Frame and Internal Structure

Now, the manner of fixing the frame 30 and the internal structure 20 will be described with reference to FIGS. 3 to 6.

To begin with, engagement between the frame 30 and the internal structure 20 at the bottom of the image forming apparatus 10 will be described.

Figure 3:
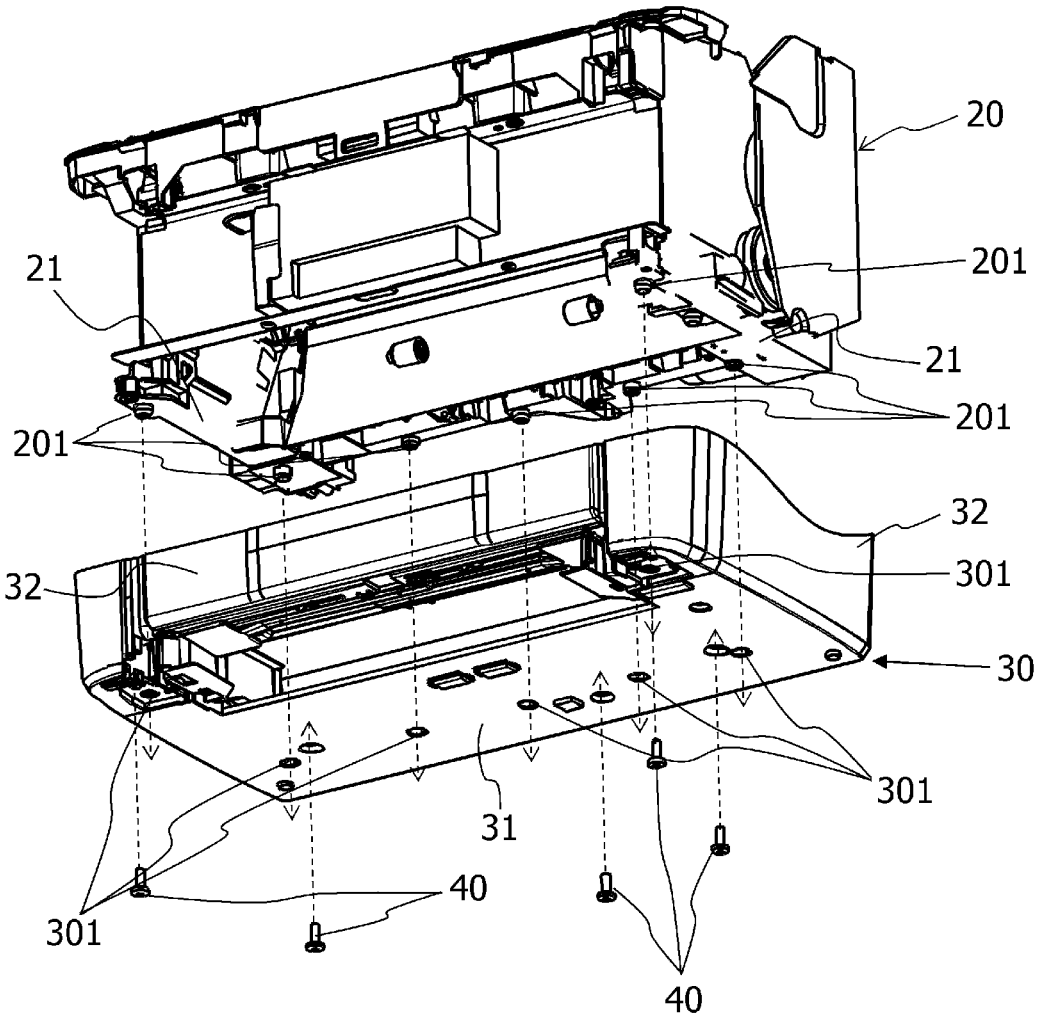
FIG. 3 is a view for illustrating how an internal structure and a frame are fixed at a bottom part of the image forming apparatus according to the first embodiment.

FIG. 3 is a perspective view of the frame 30 and the internal structure 20 as viewed from the front and below. Only the part of the frame 30 in the vicinity of the bottom surface 31 is illustrated for ease of description.

The image forming apparatus 10 has screws 40 used to fix the internal structure 20 to the bottom surface 31 of the frame 30. Positioning bosses 201 for positioning with respect to the frame 30 are formed at the bottom surface 21 of the internal structure 20, and positioning boss holes 301 for inserting the positioning bosses 201 are formed at the bottom surface 31 of the frame 30. When the internal structure 20 and the frame 30 are assembled so that the bottom surface 21 of the internal structure 20 is supported by the bottom surface 31 of the frame 30, the positioning bosses 201 of the internal structure 20 and the positioning boss holes 301 of the frame 30 are engaged with each other. The bottom surface 31 of the frame 30 and the bottom surface 21 of the internal structure 20 are fastened to each other by screws 40, so that the internal structure 20 and the frame 30 are fixed to the bottom part of the image forming apparatus 10.

Figure 4A:
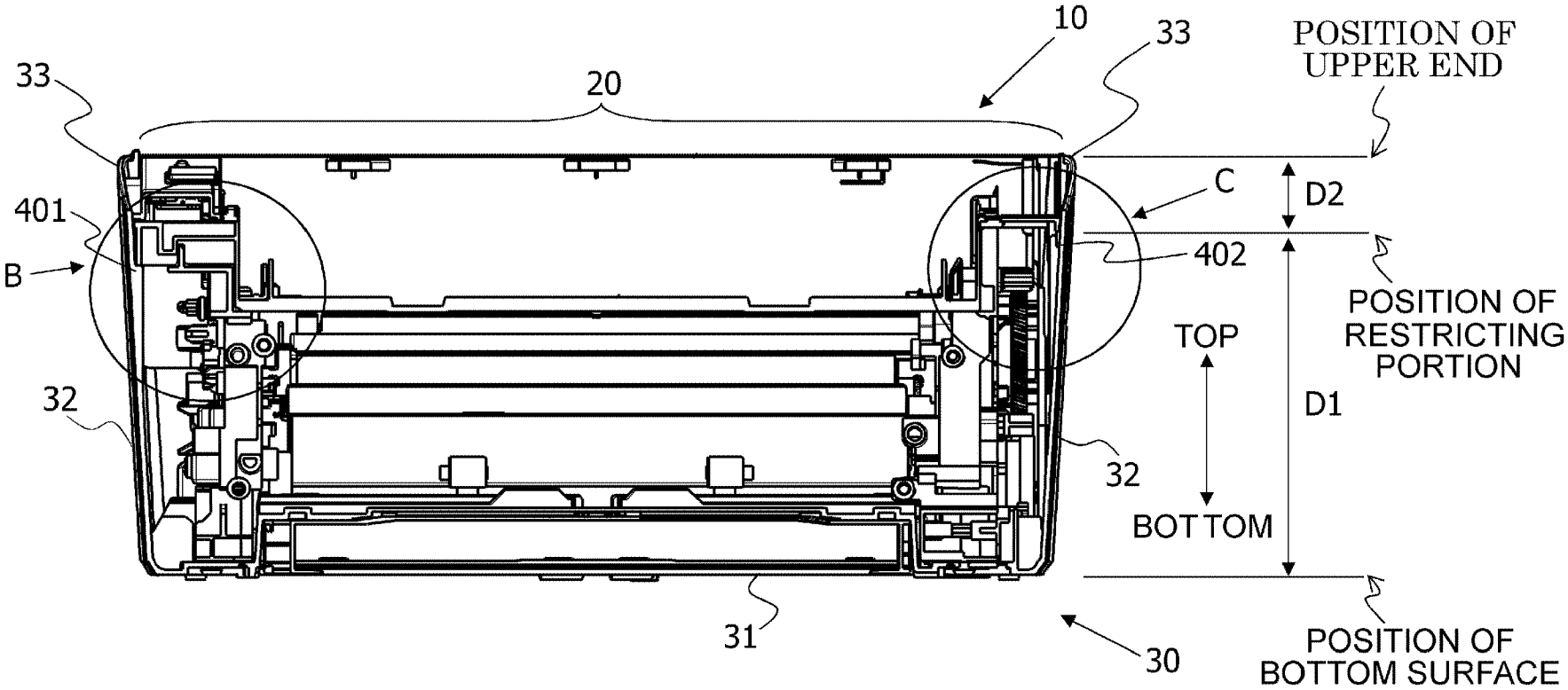
FIGS. 4A to 4E are views for illustrating an engagement arrangement for the internal structure and the frame according to the first embodiment.
Figure 4B:
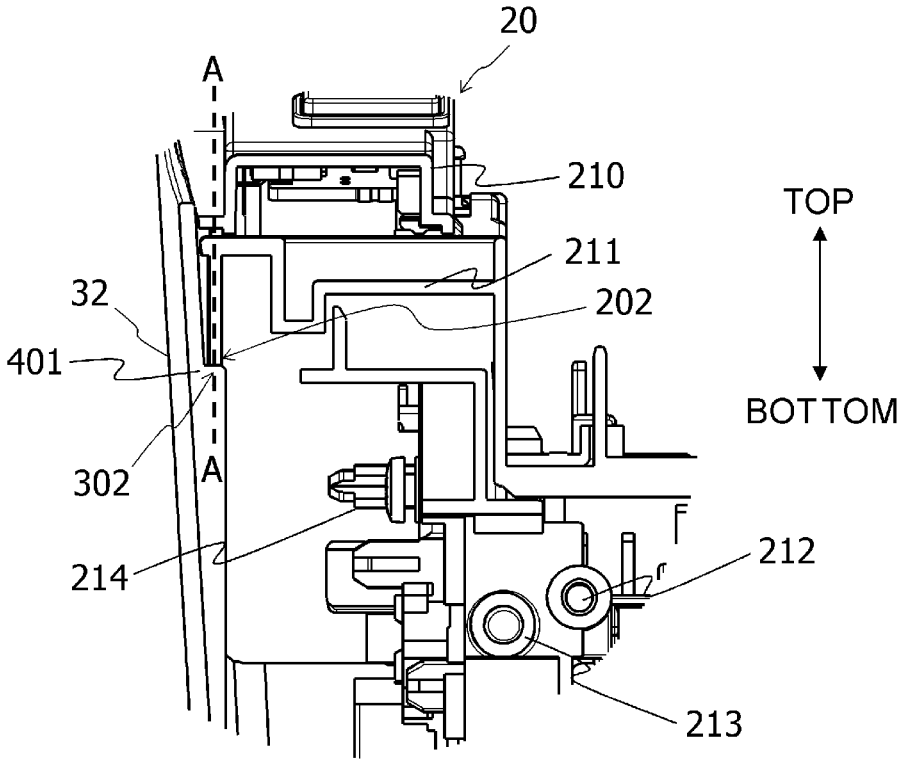
Figure 4C:
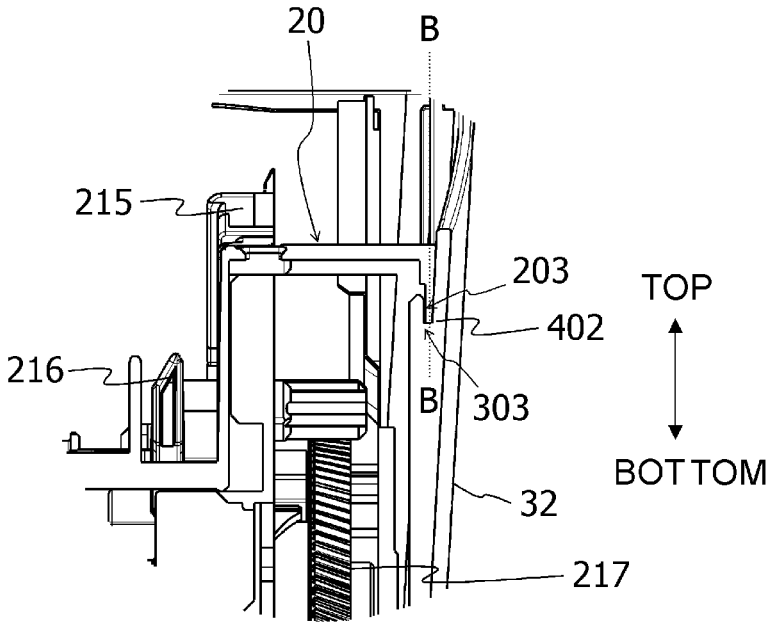
Figure 4D:
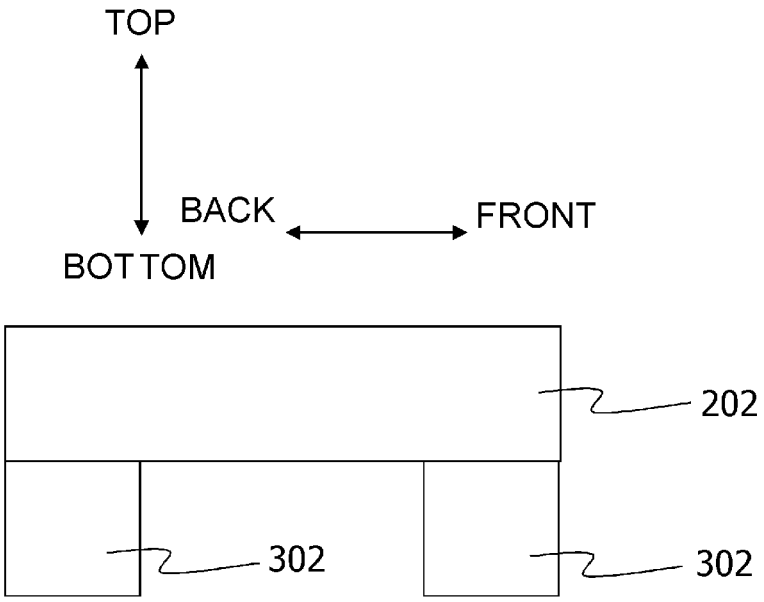
Figure 4E:
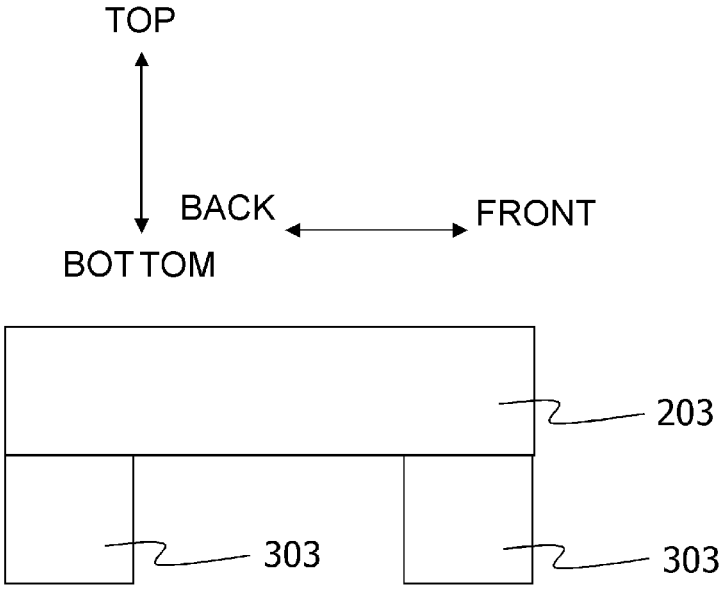

Now, engagement between the frame 30 and the internal structure 20 at the upper part of the image forming apparatus 10 will be described with reference to FIGS. 4A to 4E and 5A and 5B. FIG. 4A is a schematic sectional view of the frame 30 and the internal structure 20 taken along a section vertical to the front-back direction. FIG. 4B is an enlarged view of the part designated by B in the vicinity of a first restricting portion 401 in the left side surface of the image forming apparatus 10 in FIG. 4A. FIG. 4C is an enlarge view of the part designated by C in the vicinity of a second restricting portion 402 in the right side surface of the image forming apparatus 10 in FIG. 4A. FIG. 4D is a schematic sectional view of the first restricting portion 401 taken along the AA section indicated in FIG. 4B. FIG. 4E is a schematic sectional view of the second restricting portion 402 taken along the BB section indicated in FIG. 4C.

The frame 30 and the internal structure 20 are engaged with each other in the vicinity of the left and right side surfaces of the upper part of the image forming apparatus 10. The image forming apparatus 10 includes the first and second restricting portions 401 and 402 as multiple restricting portions for restricting relative movement between the internal structure 20 and the frame 30 in the top-bottom direction vertical to the bottom surface 31. According to the embodiment, the frame 30 has the first and second restricting portions 401 and 402. The first and second restricting portions 401 and 402 are provided in the vicinity of the left and right sides of the side surface 32 of the frame 30 so that the distance between the first and second restricting portions 401 and 402 in a direction parallel to the bottom surface 31 may be as large as possible. As illustrated in FIG. 4A, D1 represents the distance in the vertical direction between the position of the first restricting portion 401 or the second restricting portion 402 and the position of the bottom surface 31 of the frame 30, and D2 represents the distance in the vertical direction between the position of the first restricting portion 401 or the second restricting portion 402 and the position of an upper end 33 of the side surface 32 of the frame 30. The first and second restricting portions 401 and 402 are provided so that the distance D2 is smaller than the distance D1. Note that while the positional relation among the bottom surface, the upper end, and the restricting portions has been described here, the distance to each of the restricting portions from a side surface end on the opposite side to the bottom surface needs only be smaller than the distance from the bottom surface thereto.

The first and second restricting portions 401 and 402 restrict relative movement between the internal structure 20 and the frame 30 in the top-bottom direction by engaging the internal structure 20 and the frame 30 in the top-bottom direction. Note that the top-bottom direction herein refers to the direction vertical to the bottom surface of the frame 30. In FIGS. 4A, 4B, and 4C, the top-bottom direction of the sheet surface corresponds to the top-bottom direction of the frame 30, the left-right direction of the sheet surface corresponds to the left-right direction of the frame 30, and the direction vertical to the sheet surface corresponds to the front-back direction of the frame 30. In FIGS. 4D and 4E, the top-bottom direction of the sheet surface corresponds to the top-bottom direction of the frame 30, the left-right direction of the sheet surface corresponds to the front-back direction of the frame 30, and the direction vertical to the sheet surface corresponds to the left-right direction of the frame 30.

In FIG. 4A, the outermost U-shaped frame member is the frame 30, and the structures inside the frame constitute the internal structure 20.

As illustrated in FIG. 4B, a first contact portion 202 provided at the internal structure 20 and a second contact portion 302 provided at the frame 30 come into contact with each other in the top-bottom direction at the first restricting portion 401 provided at the upper part of the left side surface of the image forming apparatus 10. Here, the top-bottom direction is the direction vertical to the bottom surface of the image forming apparatus 10. In this way, relative movement between the frame 30 and the internal structure 20 in the direction vertical to the bottom surface 31 is restricted. Note that in FIG. 4B, the reference numeral 210 represents a structure including a user operation button, a light source illuminating the button, and a light guide for guiding light from the light source as components of the internal structure 20. The reference numeral 211 refers to a part of the main body frame as a part of the internal structure. The reference numeral 212 represents a screw hole related to positioning and fixing of the internal structure 20, and the reference numeral 213 represents a positioning boss. The reference numeral 214 refers to a member for holding wirings at a part of the internal structure.

As illustrated in FIG. 4C, a third contact portion 203 provided at the internal structure 20 and a fourth contact portion 303 provided at the frame 30 come into contact with each other in the top-bottom direction in the second restricting portion 402 provided at the upper part of the right side surface of the image forming apparatus 10. The second restricting portion 402 has the fourth contact portion 303 in a recessed shape, and the third contact portion 203 as a projecting portion is fitted into the fourth contact portion 303. In this way, relative movement between the frame 30 and the internal structure 20 in the vertical direction to the bottom surface 31 is restricted. Note that in FIG. 4C, the reference numeral 215 represents a part of the main body frame as a component of the internal structure 20. The reference numeral 216 represents a member for positioning the process cartridge as the image forming unit. The reference numeral 217 represents a gear related to driving of the photosensitive drum 1. In the first and second restricting portions 401 and 402, a part of the internal structure 20 is configured to engage with a part of the frame 30 from above in the top-bottom direction.

As illustrated in FIG. 4D, the first contact portion 202 of the first restricting portion 401 is formed of a member having a rectangular section and extending in the vertical direction (the front-back direction, the direction parallel to the bottom surface 31) to the top-bottom direction (the direction vertical to the bottom surface 31) of the frame 30 along the side surface 32 of the frame 30. The second contact portion 302 of the first restricting portion 401 is formed of one or more members arranged at an interval in the vertical direction to the top-bottom direction (in the front-back direction) of the frame 30 along the side surface 32 of the frame 30 and having a rectangular section and a smaller size than the first contact portion 202. More specifically, the second contact portion 302 has a smaller length than the length of the first contact portion 202 in the front-back direction. As illustrated in FIG. 4D, the first and second contact portions 202 and 302 are in contact with each other in the top-bottom direction. In the description of the embodiment, two second contact portions 302 are provided, while the number of the second contact portions 302 is not limited to two when more than one contact portions are provided.

As illustrated in FIG. 4E, the third contact portion 203 of the second restricting portion 402 is formed of a member having a rectangular section and extending in the vertical direction to the top-bottom direction (in the front-back direction) of the frame 30 along the side surface 32 of the frame 30. The fourth contact portion 303 of the second restricting portion 402 is formed of one or more members arranged at an interval in the vertical direction to the top-bottom direction (in the front-back direction) of the frame 30 along the side surface 32 of the frame 30 and having a rectangular section and a smaller size than the third contact portion 203. As illustrated in FIG. 4E, the third and fourth contact portions 203 and 303 are in contact with each other in the top-bottom direction. In the description of the embodiment, two fourth contact portions 303 are provided, while the number of the fourth contact portions is not limited to two when more than one contact portions are provided.

Note that the first and second restricting portions 401 and 402 may have any other structure than the above example. The first and second restricting portions 401 and 402 may include, along the side surface 32 of the frame 30, at least one of a member having a rectangular section and extending in the front-back direction and one or more members arranged at an interval and having a rectangular section. More specifically, the first and third contact portions 202 and 203 may include one or more members arranged at an interval in the vertical direction to the top-bottom direction (in the front-back direction) of the frame 30 along the side surface 32 of the frame 30 and having a rectangular section. The second and fourth contact portions 302 and 303 may include a member having a rectangular section and extending in the vertical direction to the top-bottom direction (in the front-back direction) of the frame 30 along the side surface 32 of the frame 30. All the contact portions may include one or more members arranged at an interval in the vertical direction to the top-bottom direction (in the front-back direction) of the frame 30 along the side surface 32 of the frame 30 and having a rectangular section. All the contact portions may include a member having a rectangular section and extending in the vertical direction to the top-bottom direction (in the front-back direction) of the frame 30 along the side surface 32 of the frame 30. The sectional shape is not limited to a rectangular shape, provided that the first and second contact portions 202 and 302 may be in contact with each other in the top-bottom direction and the third and fourth contact portions 203 and 303 may be in contact with each other in the top-bottom direction.

The functions of the first to fourth contact portions will be described with reference to FIGS. 5A and 5B.

Figure 5A:
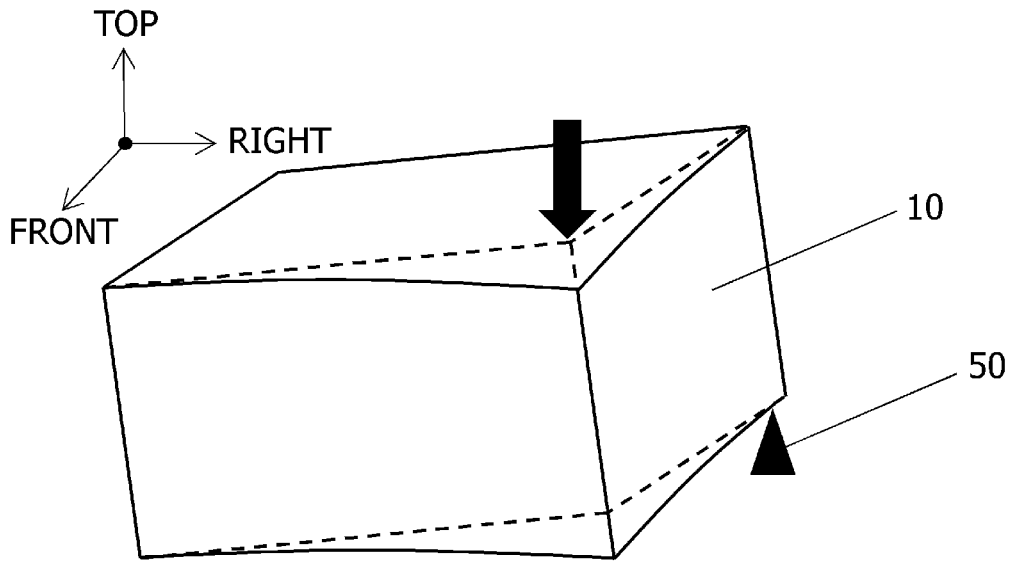
FIGS. 5A and 5B are views for illustrating deformation of the image forming apparatus according to the first embodiment in the left-right direction.
Figure 5B:
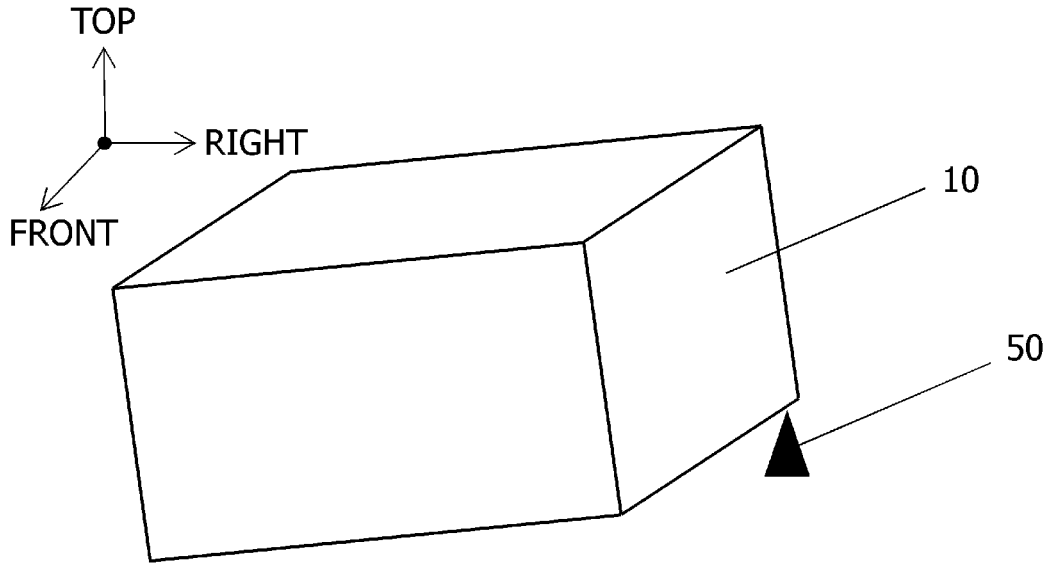

FIGS. 5A and 5B are schematic views illustrating the case in which deformation causing force acts upon the entire apparatus. In FIG. 5A, the apparatus is installed while a front right part of the apparatus is in a lifted state. This may happen when the image forming apparatus 10 is installed on an installation surface with a step 50 and the rear right part of the image forming apparatus 10 is placed on the step 50. In this state, force which can deform the front right part of the image forming apparatus 10 downward acts on the image forming apparatus 10. When the image forming apparatus 10 is used in a deformed state as in FIG. 5A, the relative position between the optical unit 18 and the photosensitive drum 1 may be shifted, which may lead to image degradation.

In contrast, in the image forming apparatus 10 according to the first embodiment, when for example the front right part of the internal structure 20 is about to be deformed downward, the third contact portion 203 of the internal structure 20 contacts the fourth contact portion 303 of the frame 30, and the internal structure 20 is supported because of the rigidity of the frame 30. In this way, relative movement between the internal structure 20 and the frame 30 in the vertical direction is restricted and deformation of the internal structure 20 is restrained. When the front right part of the frame 30 is about to be deformed downward, the second contact portion 302 of the frame 30 begins to move upward because of the rigidity of the frame 30. However, the second contact portion 302 contacts the first contact portion 202 of the internal structure 20, so that relative movement between the internal structure 20 and the frame 30 in the vertical direction is restricted, and therefore deformation of the frame 30 is restrained. Therefore, when the image forming apparatus 10 is installed while the front right part of the image forming apparatus 10 is in a lifted state, the front right parts of the frame 30 and the internal structure 20 can be restrained from being deformed as illustrated in FIG. 5B.

Now, engagement between the frame 30 and the internal structure 20 on the front side of the image forming apparatus 10 will be described with reference to FIGS. 6, 7A, and 7B. The frame 30 and the internal structure 20 are engaged with each other in the vicinity of the center of the image forming apparatus 10 on the front side.

Figure 6:
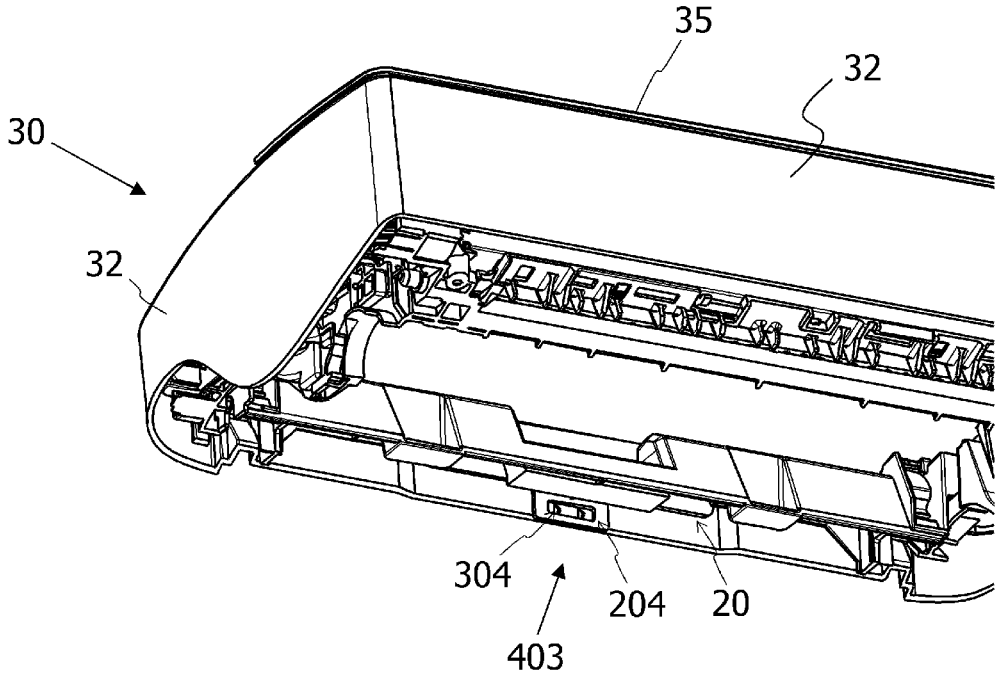
FIG. 6 is a view for illustrating an engagement arrangement for the internal structure and the frame at an upper part of the image forming apparatus according to the first embodiment.

FIG. 6 is a perspective view of the internal structure 20 and the frame 30 as viewed from the back and below. For ease of description, only a part of the upper parts of the internal structure 20 and the frame 30 is illustrated.

The image forming apparatus 10 includes a third restricting portion 403 as a restricting portion for restricting relative movement between the internal structure 20 and the frame 30 in the top-bottom direction vertical to the bottom surface 31. The third restricting portion 403 is provided so that the distance in the vertical direction between the third restricting portion 403 and the upper end 33 (see FIG. 4A) of the side surface 32 of the frame 30 is smaller than the distance in the vertical direction between the third restricting portion 403 and the bottom surface 31 of the frame 30. In the third restricting portion 403, a fifth contact portion 204 provided at the internal structure 20 and a sixth contact portion 304 provided at the frame 30 come into contact with each other in the top-bottom direction. Here, the fifth contact portion 204 is a hole provided on the front side of the internal structure 20, and the sixth contact portion 304 is a projection provided on the front side of the frame 30. Here, the engagement arrangement between the hole and the projection is illustrated as an example, while the engagement arrangement may be any arrangement other than the above example, provided that the arrangement allows components to be in contact with each other in the top-bottom direction to restrain the frame 30 and the internal structure 20 from being shifted from each other in position in the top-bottom direction. The third restricting portion 403 restricts relative movement in the top-bottom direction between the internal structure 20 and the frame 30 by the engagement structure.

The functions of the fifth to sixth contact portions will be described with reference to FIGS. 7A and 7B.

Figure 7A:
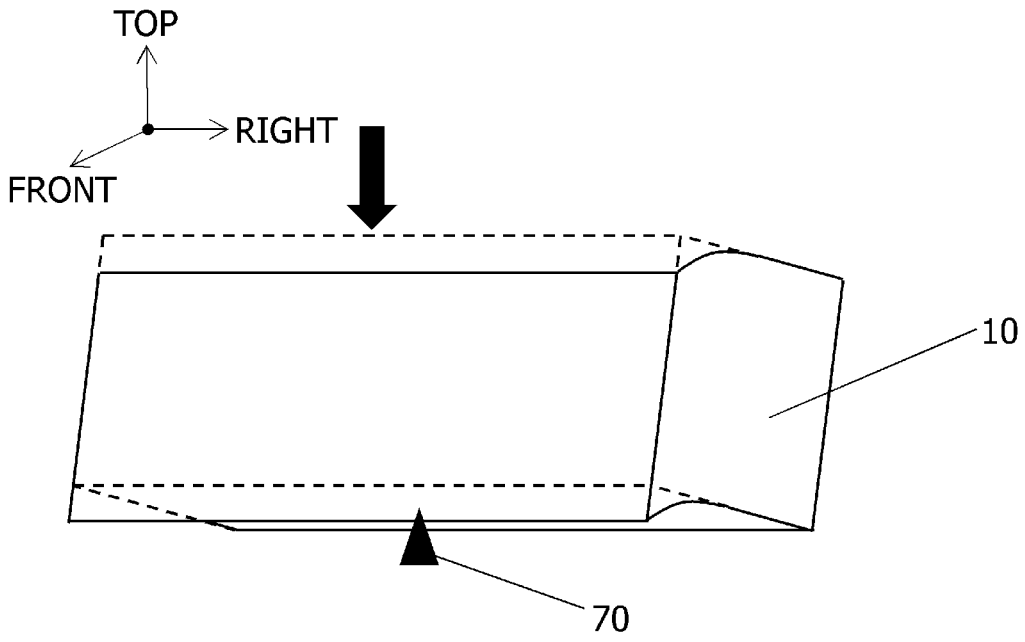
FIGS. 7A and 7B are views for illustrating deformation of the image forming apparatus according to the first embodiment in the front-back direction.
Figure 7B:
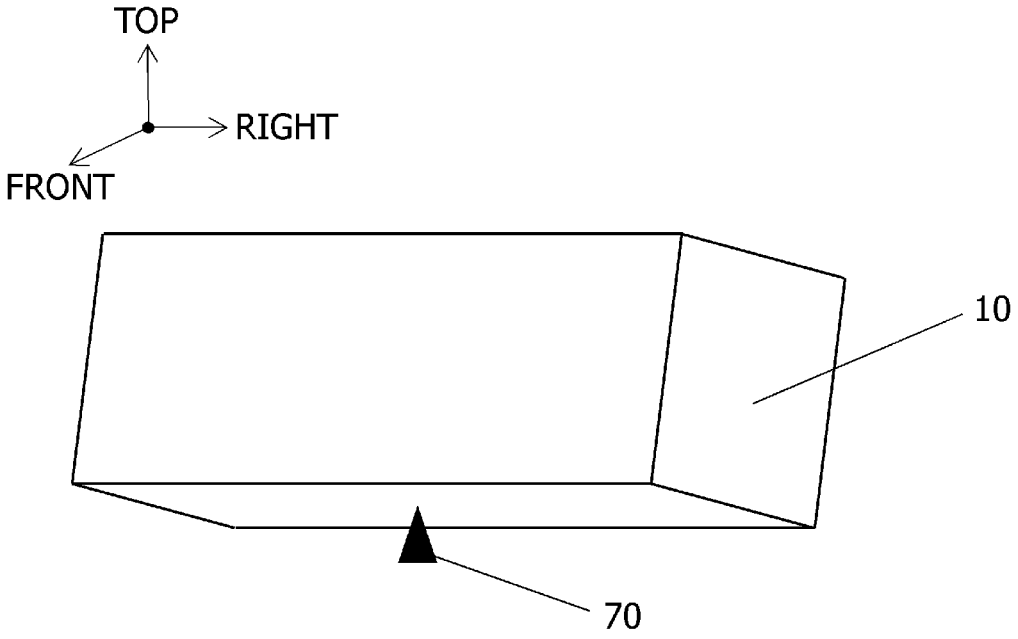

FIGS. 7A and 7B are schematic views illustrating the case in which deformation causing force acts upon the entire apparatus. FIG. 7A illustrates the case in which the apparatus is installed while the front part of the apparatus is in a lifted state. This may happen when the image forming apparatus 10 is installed on an installation surface with a step 70 and the center part of the image forming apparatus 10 is placed on the step 70. In this state, force which can deform the front part of the image forming apparatus 10 downward acts on the image forming apparatus 10. When the image forming apparatus 10 is used in a deformed state as in FIG. 7A, the relative position between the optical unit 18 and the photosensitive drum 1 may be shifted, which may lead to image degradation.

In contrast, in the image forming apparatus 10 according to the first embodiment, when the front part of the internal structure 20 is about to be deformed downward, the fifth contact portion 204 of the internal structure 20 comes into contact with the sixth contact portion 304 of the frame 30, so that relative movement in the vertical direction between the internal structure 20 and the frame 30 is restricted. In this way, the deformation of the internal structure 20 is restrained. When the front part of the frame 30 is about to be deformed downward, the fifth contact portion 204 of the internal structure 20 and the sixth contact portion 304 of the frame 30 come into contact with each other, so that relative movement in the vertical direction between the internal structure 20 and the frame 30 is restricted. In this way, the deformation of the frame 30 is restrained. Therefore, as illustrated in FIG. 7B, the front parts of the frame 30 and the internal structure 20 can be restrained from being deformed downward.

Note that the frame 30 and the internal structure 20 are engaged in the top-bottom direction in the vicinity of the front side of the image forming apparatus 10 by way of illustration, while the same engagement arrangement may also be provided in the vicinity of the rear side of the image forming apparatus 10. In this way, it may be ensured that the frame 30 and the internal structure 20 can be restrained from being deformed.

As in the foregoing, according to the first embodiment, the internal structure 20 is fixed to the bottom surface 31 of the frame 30 by the screws 40, and the restricting portions 401, 402, and 403 for restricting relative movement between the frame 30 and the internal structure 20 in the direction vertical to the bottom surface 31 are provided at the side surface 32 which extends upward from the bottom surface 31 of the frame 30. In this way, the deformation of the image forming apparatus 10 can be restrained using the rigidity of both the frame 30 and the internal structure 20 against external deformation causing force acting on the image forming apparatus 10. Therefore, the rigidity of the image forming apparatus 10 as a whole can be secured when the upper cover 35 is not formed to have high rigidity. In this way, the rigidity of the image forming apparatus 10 as a whole including the internal structure can be secured without using a plurality of frames having high rigidity, which restrains the cost and the size from increasing.

The foregoing illustrates an example of the present invention and the same is not intended to limit the invention. For example, according to the first embodiment, the first and second restricting portions 401 and 402 for restricting relative movement in the vertical direction between the frame 30 and the internal structure 20 are provided linearly along the left and right of the side surface 32 of the frame 30 but an engagement arrangement including a hole and a projection similarly to the third restricting portion 403 may be provided. One third restricting portion 403 is provided in the center of the image forming apparatus 10 by way of illustration, but the restricting portion may be provided in a plurality at prescribed intervals. According to the first embodiment, multiple restricting portions are provided, while only one restricting portion may be provided. The restricting portion may be any arrangement other than the engagement arrangement between the contact portions provided at the frame 30 and the contact portions provided at the internal structure 20 or the engagement arrangement between the projection provided at the frame 30 and the hole provided at the internal structure 20. The contact portions which form the restricting portions are provided both at the frame 30 and the internal structure 20, but the contact portion may be provided at at least one of the frame 30 and the internal structure 20. According to the first embodiment, the side surface 32 of the frame 30 includes the front, back, left, and right planes and curved surfaces which smoothly connect these planes by way of illustration. However, the frame 30 according to the present invention may have any other structure, provided that the frame 30 has a bottom surface and a side surface which extends upward from the bottom surface, and the surfaces other than the upper opening are connected to surround the internal structure 20. For example, the frame 30 may be in a bottomed cylindrical shape having a circular bottom surface and a tubular side surface which extends upward. The side surface which extends upward from the bottom surface does not have to extend upward at the right angle with respect to the bottom surface. When the present invention is applied to an image forming apparatus having a bottomed cylindrical frame, a plurality of restricting portions may be provided in the vicinity of crossing points between a straight line passing through the center axis of the cylinder and parallel to the bottom surface and a side surface. In this way, the intervals of the plurality of restricting portions in the direction parallel to the bottom surface may be as large as possible.

Second Embodiment

According to the first embodiment, in the engagement arrangement between the frame 30 and the internal structure 20 at the upper part of the image forming apparatus 10, the engagement part of the internal structure 20 is contacted from above to the engagement part of the frame 30 by way of illustration. However, the arrangement is not intended to limit the invention.

Figure 8A:
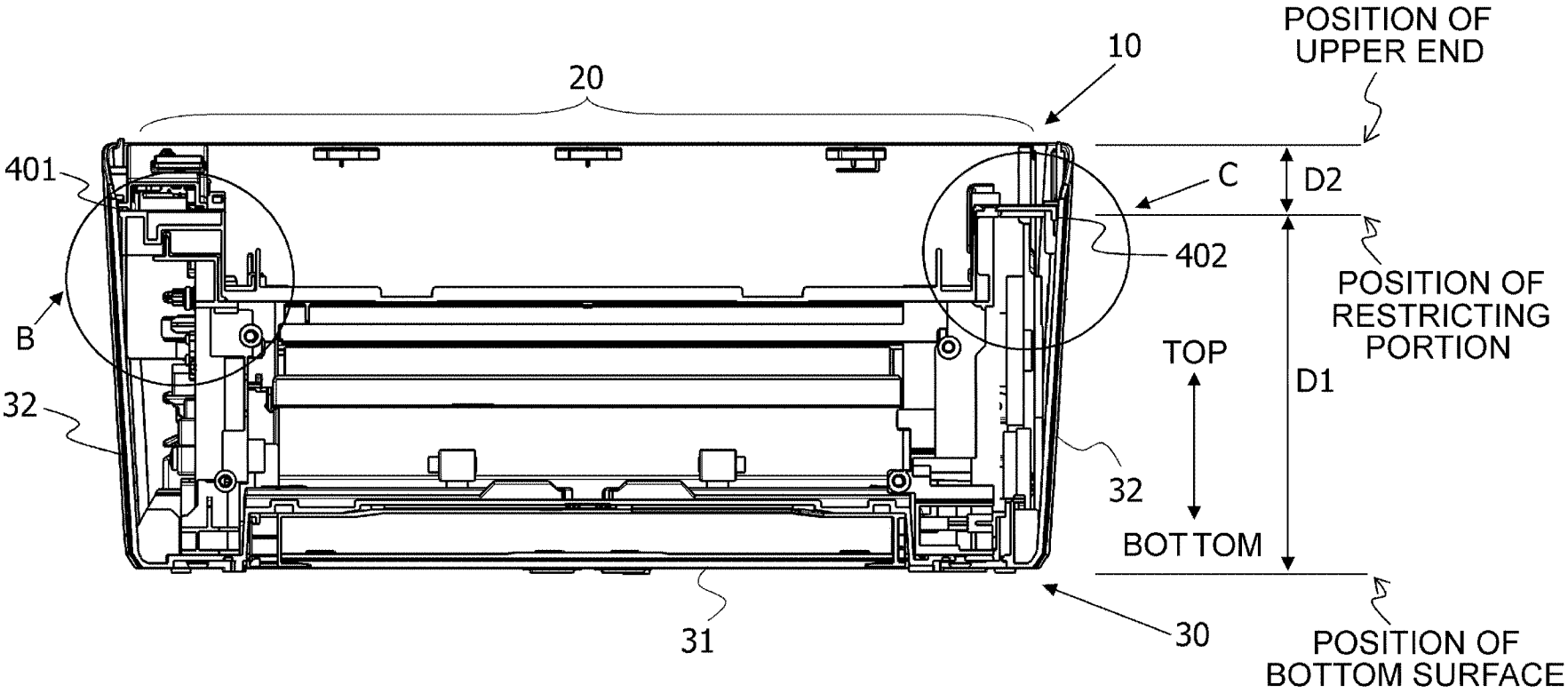
FIGS. 8A to 8E are views for illustrating an engagement arrangement for an internal structure and a frame according to a second embodiment of the present invention.
Figure 8B:
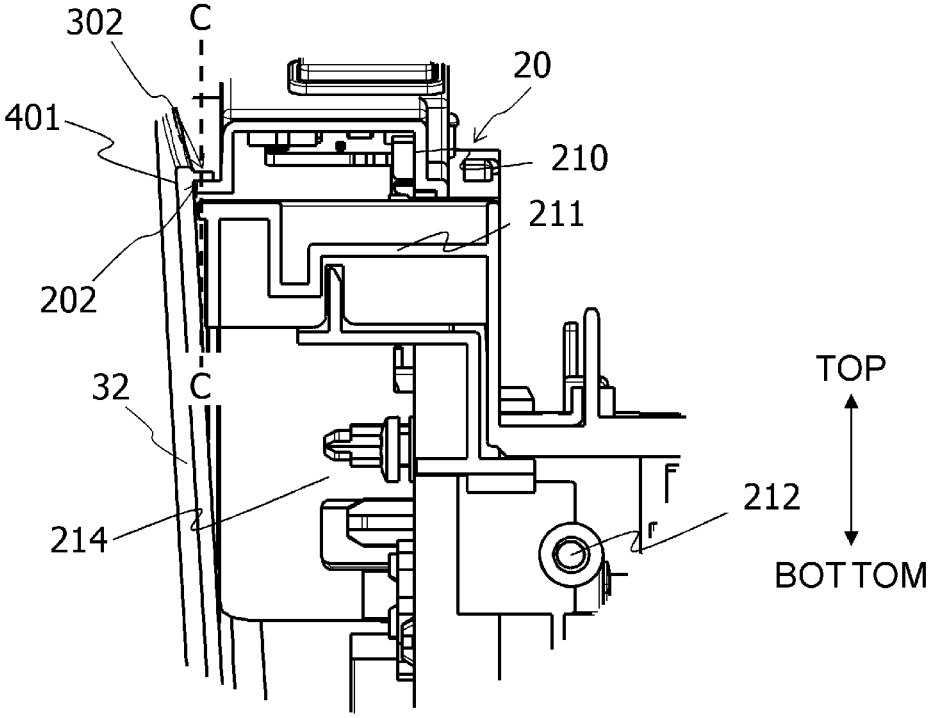
Figure 8C:
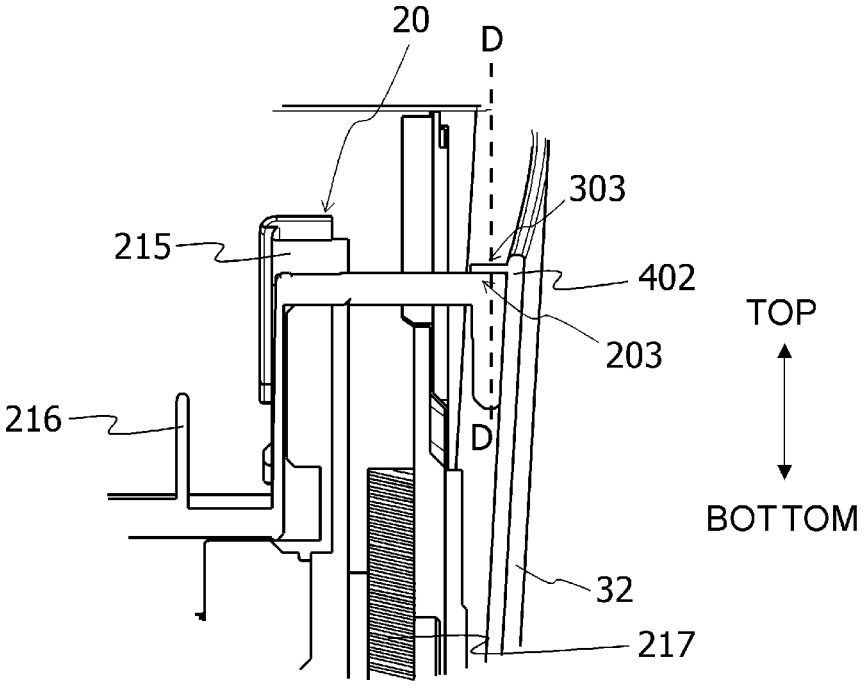
Figure 8D:
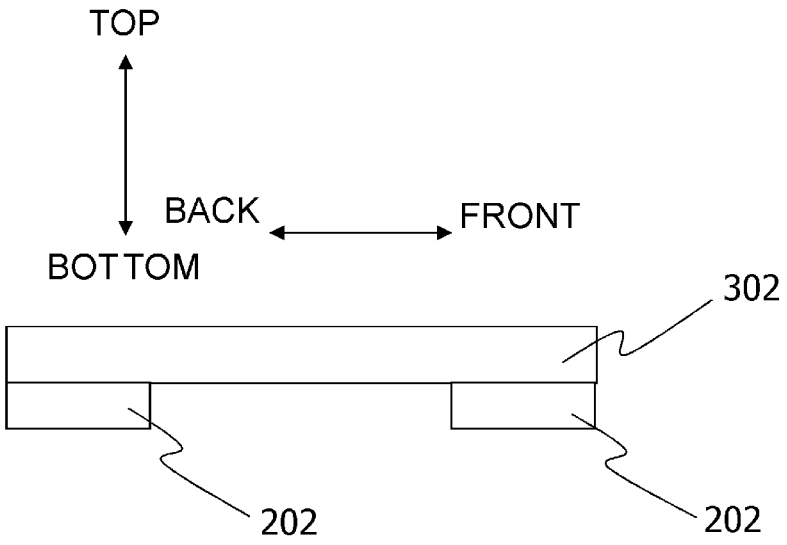
Figure 8E:
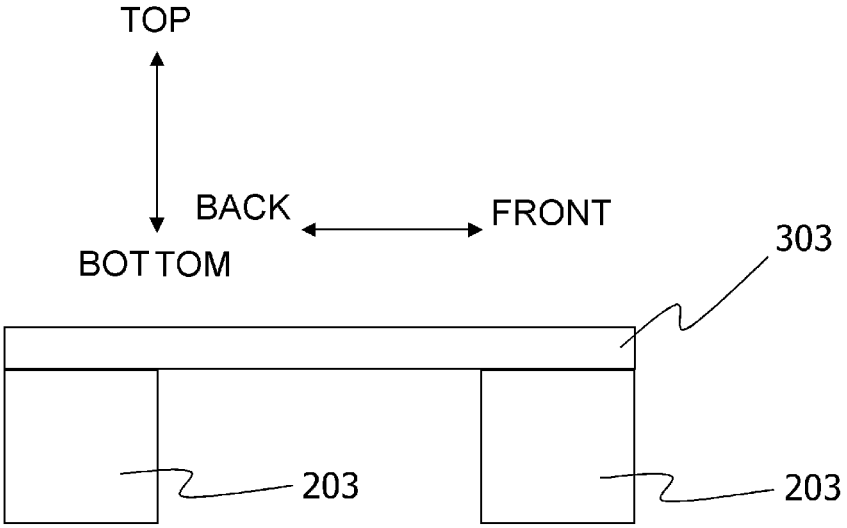
Figure 9:
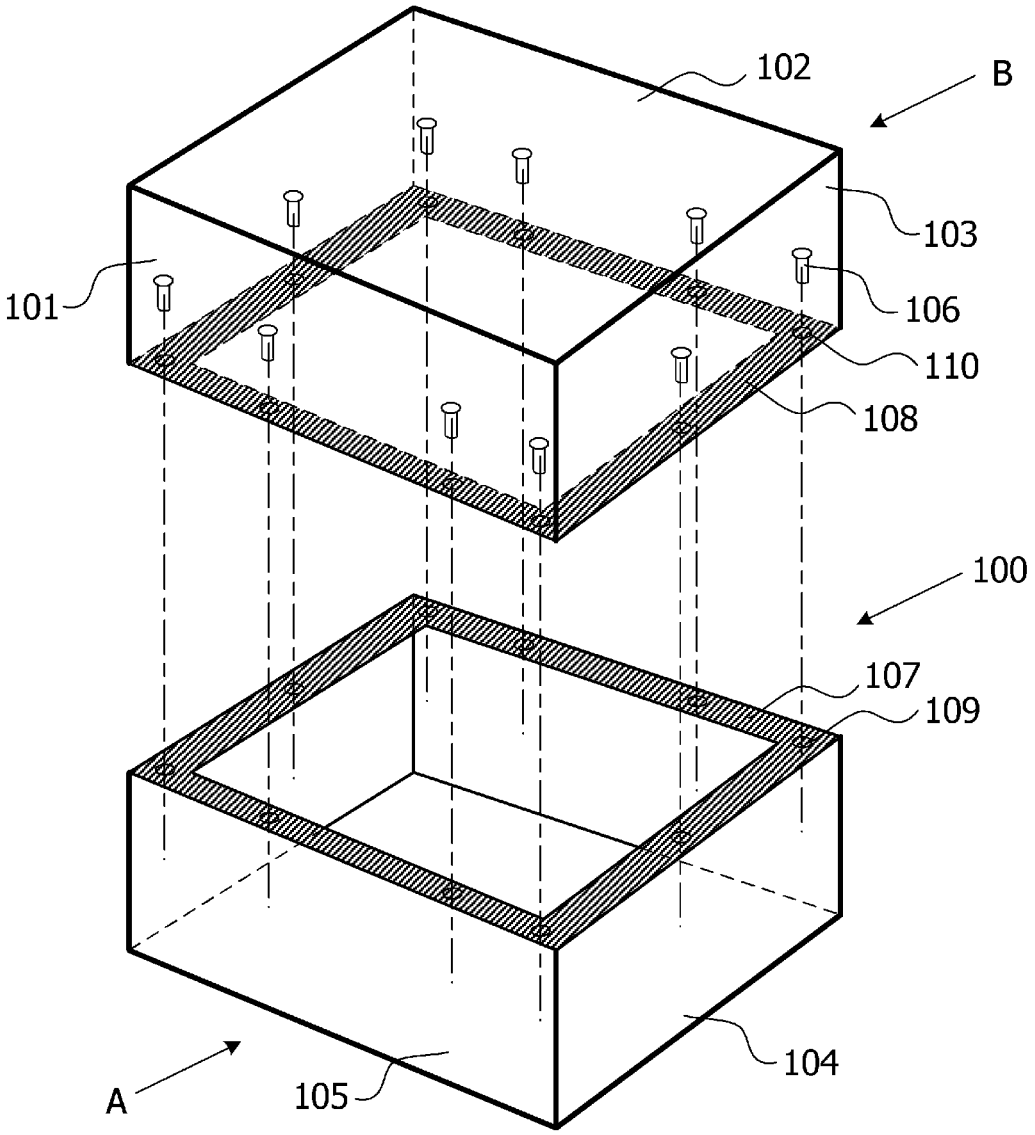
FIG. 9 is a view for illustrating a conventional arrangement.

FIG. 8A is a schematic sectional view taken along a section vertical to the front-back of the frame 30 and the internal structure 20. FIG. 8B is an enlarged view of the part designated by B in the vicinity of the first restricting portion 401 on the left side surface of the image forming apparatus 10 in FIG. 8A. FIG. 8C is an enlarged view of the part designated by C in the vicinity of the second restricting portion 402 on the right side surface of the image forming apparatus 10 in FIG. 8A. FIG. 8D is a schematic sectional view of the first restricting portion 401 taken along the section CC in FIG. 8B. FIG. 8E is a schematic sectional view of the second restricting portion 402 taken along the section DD in FIG. 8C. In FIGS. 8A, 8B, and 8C, the top-bottom direction of the sheet surface corresponds to the top-bottom direction of the frame 30, the left-right direction of the sheet surface corresponds to the left-right direction of the frame 30, and the direction vertical to the sheet surface corresponds to the front-back direction of the frame 30. In FIGS. 8D and 8E, the top-bottom direction of the sheet surface corresponds to the top-bottom direction of the frame 30, the left-right direction of the sheet surface corresponds to the front-back direction of the frame 30, and the direction vertical to the sheet surface corresponds to the left-right direction of the frame 30.

In FIG. 8A, the outermost upward U-shaped frame is the frame 30, and the structures inside the frame constitute the internal structure 20. As illustrated in FIG. 8A, D1 represents the distance in the vertical direction between the position of the first restricting portion 401 or the second restricting portion 402 and the position of the bottom surface 31 of the frame 30, and D2 represents the distance in the vertical direction between the position of the first restricting portion 401 or the second restricting portion 402 and the position of the upper end 33 of the side surface 32 of the frame 30. The first and second restricting portions 401 and 402 are provided so that the distance D2 is smaller than the distance D1. Note that while the positional relation among the bottom surface, the upper end, and the restricting portions has been described, the distance to each of the restricting portions from a side surface end on the opposite side to the bottom surface needs only be smaller than the distance from the bottom surface thereto.

As illustrated in FIG. 8B, in the first restricting portion 401 provided at the upper part of the left side surface of the apparatus, the first contact portion 202 provided at the internal structure 20 and the second contact portion 302 provided at the frame 30 come into contact with each other in the top-bottom direction. Note that the reference numerals 210, 211, 212, 214 representing components of the internal structure 20 in FIG. 8B designate the same components in FIG. 4B.

As illustrated in FIG. 8C, in the second restricting portion 402 provided at the upper part of the right side surface of the apparatus, the third contact portion 203 provided at the internal structure 20 and the fourth contact portion 303 provided at the frame 30 come into contact with each other in the top-bottom direction. Note that the reference numerals 215, 216, and 217 representing components of the internal structure 20 in FIG. 8C designate the same components in FIG. 4C.

As illustrated in FIG. 8D, the second contact portion 302 of the first restricting portion 401 is formed of a member having a rectangular section and extending in the vertical direction (the front-back direction, the direction parallel to the bottom surface 31) to the top-bottom direction (the vertical direction to the bottom surface 31) of the frame 30 along the side surface 32 of the frame 30. The first contact portion 202 of the first restricting portion 401 is formed of one or more members arranged at an interval in the direction vertical to the top-bottom direction (in the front-back direction) of the frame 30 along the side surface 32 of the frame 30 and having a rectangular section and a smaller size than the second contact portion 302. Stated differently, the length of the first contact portion 202 in the front-back direction is greater than the length of the second contact portion 302. As illustrated in FIG. 8D, the first and second contact portions 202 and 302 are in contact with each other in the top-bottom direction. In the description of the embodiment, two first contact portions 202 are provided by way of illustration, but the number of the contact portions may be two or more.

As illustrated in FIG. 8E, the fourth contact portion 303 of the second restricting portion 402 is formed of a member having a rectangular section and extending in the direction vertical to the top-bottom direction (in the front-back direction) of the frame 30 along the side surface 32 of the frame 30. The third contact portion 203 of the second restricting portion 402 is formed of one or more members arranged at an interval in the direction vertical to the top-bottom direction (in the front-back direction) of the frame 30 along the side surface 32 of the frame 30 and having a rectangular section and a smaller size than the fourth contact portion 303. As illustrated in FIG. 8E, the third and fourth contact portions 203 and 303 are in contact with each other in the top-bottom direction. In the description of the embodiment, two third contact portions 203 are provided by way of illustration, but the number of the contact portions is not limited to two.

Note that the first and second restricting portions 401 and 402 may have other structures than the above example. The first and second restricting portions 401 and 402 may include at least one of a member having a rectangular section and extending in the front-back direction along the side surface 32 of the frame 30 and one or more members arranged at an interval and having a rectangular section. More specifically, the second and fourth contact portions 302 and 303 may include one or more members arranged at an interval in the direction vertical to the top-bottom direction (in the front-back direction) of the frame 30 along the side surface 32 of the frame 30. The first and third contact portions 202 and 203 may include a member having a rectangular section and extending in the direction vertical to the top-bottom direction (in the front-back direction) of the frame 30 along the side surface 32 of the frame 30. All the contact portions may include one or more members arranged at an interval in the vertical direction to the top-bottom direction (in the front-back direction) of the frame 30 along the side surface 32 of the frame 30 and having a rectangular section. All the contact portions may include a member having a rectangular section and extending in the vertical direction to the top-bottom direction (in the front-back direction) of the frame 30 along the side surface 32 of the frame 30. The sectional shape is not limited to the rectangular shape, provided that the first and second contact portions 202 and 302 may be in contact with each other in the top-bottom direction, and the third and fourth contact portions 203 and 303 may be in contact with each other in the top-bottom direction.

In contrast to the first embodiment, according to the second embodiment, in the first and second restricting portions 401 and 402, a part of the frame 30 is configured to engage with a part of the internal structure 20 from above in the top-bottom direction. Note that also according to the second embodiment, at least one of the first and second restricting portions 401 and 402 may have the same recessed structure as the second restricting portion 402 according to the first embodiment. In this case, as opposed to the second restricting portion 402 according to the first embodiment, the fourth contact portion 303 according to the second embodiment may be formed to have a downward recessed structure, and the third contact portion 203 may be formed to be fitted from below into the fourth contact portion 303 as the recessed structure.

When for example the front right part of the internal structure 20 is about to be deformed downward, the first and second restricting portions 401 and 402 allow the second contact portion 302 of the frame 30 to contact the first contact portion 202 which would otherwise move upward by the rigidity of the internal structure 20. In this way, relative movement between the internal structure 20 and the frame 30 in the vertical direction can be restricted, so that the deformation of the internal structure 20 may be restrained. When the front right part of the frame 30 is about to be deformed downward, the third contact portion 203 and the fourth contact portion 303 come into contact with each other, so that the frame 30 is supported by the internal structure 20. In this way, relative movement in the vertical direction between the internal structure 20 and the frame 30 is restricted, so that the deformation of the frame 30 can be restrained. Therefore, when the apparatus is installed while its front right part is in a lifted state, the front right parts of the frame 30 and the internal structure 20 can be restrained from being deformed downward as illustrated in FIG. 5B.

As in the foregoing, according to the second embodiment, the internal structure 20 is fixed to the bottom surface 31 of the frame 30 by the screws 40, and the first and second restricting portions 401 and 402 for restricting relative movement between the frame 30 and the internal structure 20 in the direction vertical to the bottom surface 31 are provided at the side surface 32 which extends upward from the bottom surface 31 of the frame 30. In this way, the deformation of the image forming apparatus 10 can be restrained using the rigidity of both the frame 30 and the internal structure 20 against external force causing deformation acting on the image forming apparatus 10. Therefore, the total rigidity of the image forming apparatus 10 including the internal structure 20 can be secured without using a plurality of frames with high rigidity similarly to the first embodiment, which can restrain the cost and the size from increasing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-009611, filed on Jan. 24, 2018, which is hereby incorporated by reference herein in its entirety.

What is claimed is:

1. An image forming apparatus, comprising:

a casing molded from a resin and having (i) a bottom portion and (ii) a side portion formed integrally with the bottom portion so as to extend upward from the bottom portion, the side portion including a restricting surface crossing a vertical direction with respect to the bottom portion; and a frame capable of supporting an image forming portion for forming an image on a recording material, the frame including a restricted surface crossing the vertical direction, wherein the side portion surrounds the frame, wherein, when the frame is fixed to the bottom portion of the casing by a screw, the restricted surface contacts the restricting surface and restricts movement of the frame in the vertical direction, and the restricting surface is provided in a position at a smaller distance from an end of the side portion than from the bottom portion in the vertical direction.

2. The image forming apparatus according to claim 1, wherein the restricting surface is one of a plurality of restricting surfaces.

3. The image forming apparatus according to claim 2, wherein the plurality of restricting surfaces is provided at a largest possible interval in a direction parallel to the bottom portion.

4. The image forming apparatus according to claim 1, wherein a distance between the restricting surface and an upper end of the side portion in the vertical direction is smaller than a distance between the restricting surface and the bottom portion in the vertical direction.

5. The image forming apparatus according to claim 1, wherein the restricting surface is configured so that a part of the frame engages with a part of the casing from above in the vertical direction.

6. The image forming apparatus according to claim 1, wherein the restricting surface is configured so that a part of the casing engages with a part of the frame from above in the vertical direction.

7. The image forming apparatus according to claim 1, wherein the image forming portion is adapted to form an image on the recording material using a photosensitive member.

8. The image forming apparatus according to claim 1, wherein the restricting surface has a recessed structure.

9. The image forming apparatus according to claim 1, wherein the image forming portion is a process cartridge having a photosensitive member and is attachable to and detachable from the image forming apparatus.

10. The image forming apparatus according to claim 1, wherein the restricting surface is a member which extends in a direction parallel to the bottom portion along the side portion of the casing, and wherein a plurality of contact portions, movement of which is restricted by contacting the restricting surface, are members arranged at an interval in the direction parallel to the bottom portion along the side portion of the casing.

* * * * *